US006401413B1

(12) United States Patent
Niemann

(10) Patent No.: US 6,401,413 B1
(45) Date of Patent: Jun. 11, 2002

(54) CONCRETE FORM WALL BUILDING SYSTEM

(76) Inventor: Michael H. Niemann, 5750 Columbine Dr., Johnston, IA (US) 50131

( * ) Notice: Subject to any disclaimer, the term of this patent is extended or adjusted under 35 U.S.C. 154(b) by 0 days.

(21) Appl. No.: 09/609,189

(22) Filed: Jun. 30, 2000

Related U.S. Application Data

(63) Continuation-in-part of application No. 09/389,607, filed on Sep. 3, 1999.

(51) Int. Cl.[7] ..... E04B 2/34

(52) U.S. Cl. ..... 52/309.12; 52/309.11; 52/421; 52/426; 52/793.11

(58) Field of Search ..... 52/309.2, 309.11, 52/309.12, 309.17, 421, 426, 793.11, 793.1, 309.7, 309.16, 431

(56) References Cited

U.S. PATENT DOCUMENTS 1,616,977 A * 2/1927 Koivu ..... 52/426
3,552,076 A * 1/1971 Gregori ..... 52/309.12
4,004,774 A * 1/1977 Houston ..... 249/114
4,190,999 A * 3/1980 Hampton ..... 52/687
4,671,032 A * 6/1987 Reynolds ..... 52/793.11
4,924,641 A * 5/1990 Gibbar, Jr. ..... 52/204.1
5,465,542 A * 11/1995 Terry ..... 52/309.7
5,568,710 A * 10/1996 Smith ..... 52/426
5,640,817 A * 6/1997 Bos ..... 52/421
5,819,489 A * 10/1998 McKinney ..... 52/435

* cited by examiner

*Primary Examiner*—Carl D. Friedman
*Assistant Examiner*—Jennifer I. Thissell
(74) *Attorney, Agent, or Firm*—G. Brian Pingel; Camille L. Urban

(57) ABSTRACT

An insulated concrete form wall building system wherein a first embodiment includes a pair of spaced apart elongated expanded polystyrene sidewalls, each having opposed inner surfaces that are formed with longitudinally spaced apart vertically oriented ribs that terminate in substantially flat surfaces to abut against one another to serve as a concrete wall form. A second embodiment includes a pair of spaced apart elongated expanded polystyrene sidewalls and divisional members with flat sides which are attached to said sidewalls to serve as a concrete wall form. The ribs define channels for receiving concrete poured therein to form a composite polystyrene and concrete wall structure in the first embodiment and the divisional members serve the same function in the second embodiment.

11 Claims, 10 Drawing Sheets

Fig. 7
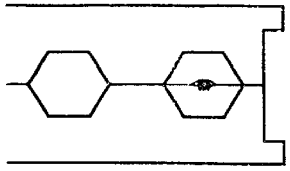
Fig. 4
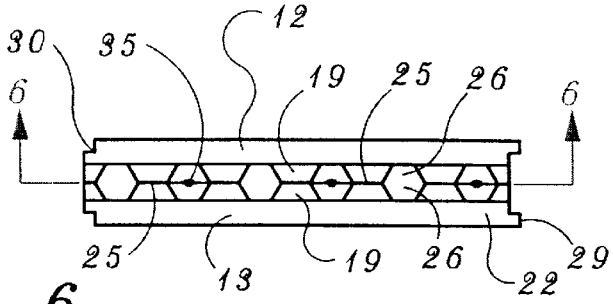
Fig. 6
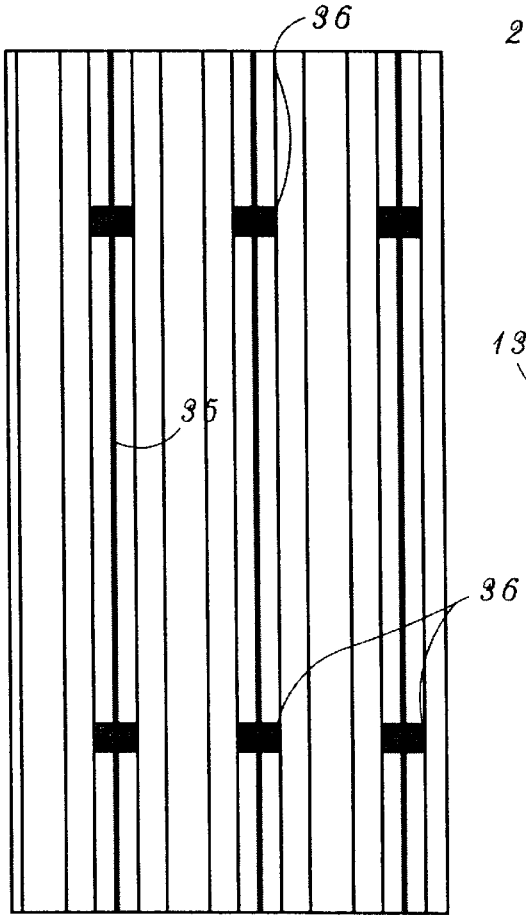
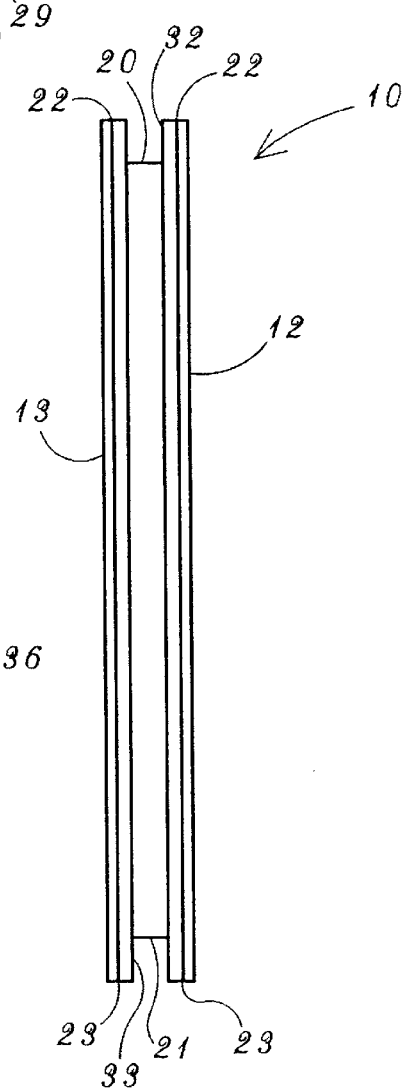
Fig. 5

CONCRETE FORM WALL BUILDING SYSTEM

This is a continuation in part of application Ser. No. 09/389,607 filed Sep. 3, 1999.

BACKGROUND OF THE INVENTION

1. Field of the Invention

The present invention relates in general to an insulated concrete form wall building system and more particularly to a form provided by expanded polystyrene sidewalls between which channels are formed and into which concrete in slurry form is poured and thereby becomes a part of the permanent wall structure.

2. Description of the Prior Art

The use of insulated concrete form wall building systems has been known for several decades as a means of eliminating the use of metal or wooden forms for the onsite construction of concrete walls for buildings. Although the use of metal or wooden forms provides a reliable means for making wall structures, such use suffers from the disadvantage that the forms are cumbersome and awkward to use and they must be removed after the concrete is sufficiently hard to allow their removal so that they do not end up forming a part of the wall structure. Such activity is labor intensive and particularly results in a substantial amount of on site labor in positioning the forms for pouring of the concrete.

Currently, competitive insulated concrete form building systems employ the use of expanded polystyrene material and fall into two basic categories, block style and sheet style. Block style systems use a molded expanded polystyrene building block system which is stacked in a building block configuration to form the concrete walls. The block style systems are easy to use, but they require a substantial amount of on site labor to assemble. The blocks typically incorporate internal clips or brackets that are designed to strengthen the joints therebetween. One of the principal disadvantages of the block style systems is that they do not readily accommodate openings for windows or doors, which limits their practical use primarily to separate wall systems or simple structures such as garages.

The sheets style systems use two molded expanded polystyrene sheets, one on each side of the form. Typically, the sheets are held apart by system of clips or brackets that have to be assembled on the job site and is cumbersome and labor intensive. Various methods of sealing the joints between the sheet systems have been devised but again they are all labor intensive. None of the sheet systems incorporate features for easily placing windows or doors, again resulting in costly on site labor. Another major disadvantage that both competitive systems suffer from is that they do not support the concrete without additional bracing (external forms or shoring) in order to prevent the concrete from breaking through the forms when it is poured.

Although competitive insulated concrete form systems have many shortcomings, they are gaining acceptance in the industry because of the energy savings and comfort they bring to the building structure. The use of competitive systems have been sold on their energy saving merits alone. Also, building codes are requiring insulation on the basement and foundation walls. Thus, insulated concrete form systems have been experiencing particularly increased acceptance as systems for building basements and foundation walls even though they do not provide any savings, from a construction labor standpoint, over conventional construction methods. However, their acceptance by large contractors or developers is still fairly limited.

The present invention provides an insulated concrete form building system that significantly decreases the amount of on site labor required and provides for a system in which windows and doors are readily accommodated.

SUMMARY OF THE INVENTION

A first embodiment of the present invention provides an insulated concrete form wall building system having spaced apart elongated expanded polystyrene sidewalls, each having opposed inner surfaces that are formed with longitudinally spaced apart vertically oriented ribs that terminate in substantially flat surfaces to abut against one another to serve as a concrete wall form.

The spaced apart ribs define channels for receiving concrete poured therein. Preferably, the polystyrene sidewalls are formed by cutting a single sheet of expanded polystyrene into two generally equal portions. Preferably, the top and bottom edges of the sidewall ribs have top and bottom ends that are spaced apart from the sidewall edges to provide upper and lower concrete receiving areas between the sidewalls that are in communication with the channels between the ribs. To form windows and doorways, the ribs of the sidewalls have opposed interrupted portions for receiving spacer members that are placed between the sidewalls, which spacer members are in the shape of the desired window or doorway.

A second embodiment of the present invention provides an insulated concrete form wall building system having spaced apart elongated expanded polystyrene sidewalls with divisional members positioned between the sidewalls. Each divisional member comprises top and bottom surfaces and two flat sides, one of which is attached to one sidewall and the other of which is attached to the second sidewall. The divisional members are spaced apart longitudinally along the sidewalls such that channels are formed between divisional members. The top and bottom surfaces of the divisional members are spaced apart from the top and bottom edges of the sidewalls to provide upper and lower concrete receiving areas between the sidewalls that are in communication with the channels between the divisional members. To form windows and doorways, divisional members are cut and attached to the first sidewall such that a seat the shape of the desired window or door is created. A spacer is inserted into the seat and the second sidewall attached.

A plastic barrier may be laminated to the outside surface of one or both sidewalls of the present invention negating the need for a finish coat and providing a barrier to moisture, rodents and many insects. This is especially advantageous where forms are used in subgrade positions. Preferably, this plastic barrier is in the form of an ABS plastic sheet of a thickness of about 1/16".

The foregoing and other advantages of the present invention will appear from the following description. In the description, reference is made to the accompanying drawings, which form a part of hereof, and in which they are shown by illustration, and not of limitation, a specific form in which the invention may be embodied. Such embodiments do not represent the full scope of the invention, but rather the invention may be employed in a variety of embodiments, and reference is made to the claims herein for interpreting the breadth of the invention.

BRIEF DESCRIPTION OF THE DRAWINGS

FIG. 4 is a plan view of the embodiment of FIG. 1;

FIG. 5 is an end view in elevation of the embodiment of FIG. 1;

FIG. 6 is a cross-sectional view taken along the line 6—6 of FIG. 4;

FIG. 7 is an enlarged fragmentary view of one end of the embodiment shown in FIG. 4;

DETAILED DESCRIPTION OF THE PREFERRED EMBODIMENT

The present invention provides an improved insulated concrete form wall building system that can be advantageously utilized in the construction industry as a quick and efficient means for providing insulated foundations, basements and above grade concrete walls in a manner that eliminates a substantial amount of on site construction labor and dramatically reduces on site construction and completion times. The system of the present invention offers greater versatility than that available through currently used block or sheet based insulated concrete form systems, and is suitable and applicable to interior and exterior sub grade, above grade and multi-story applications.

Figure 1:
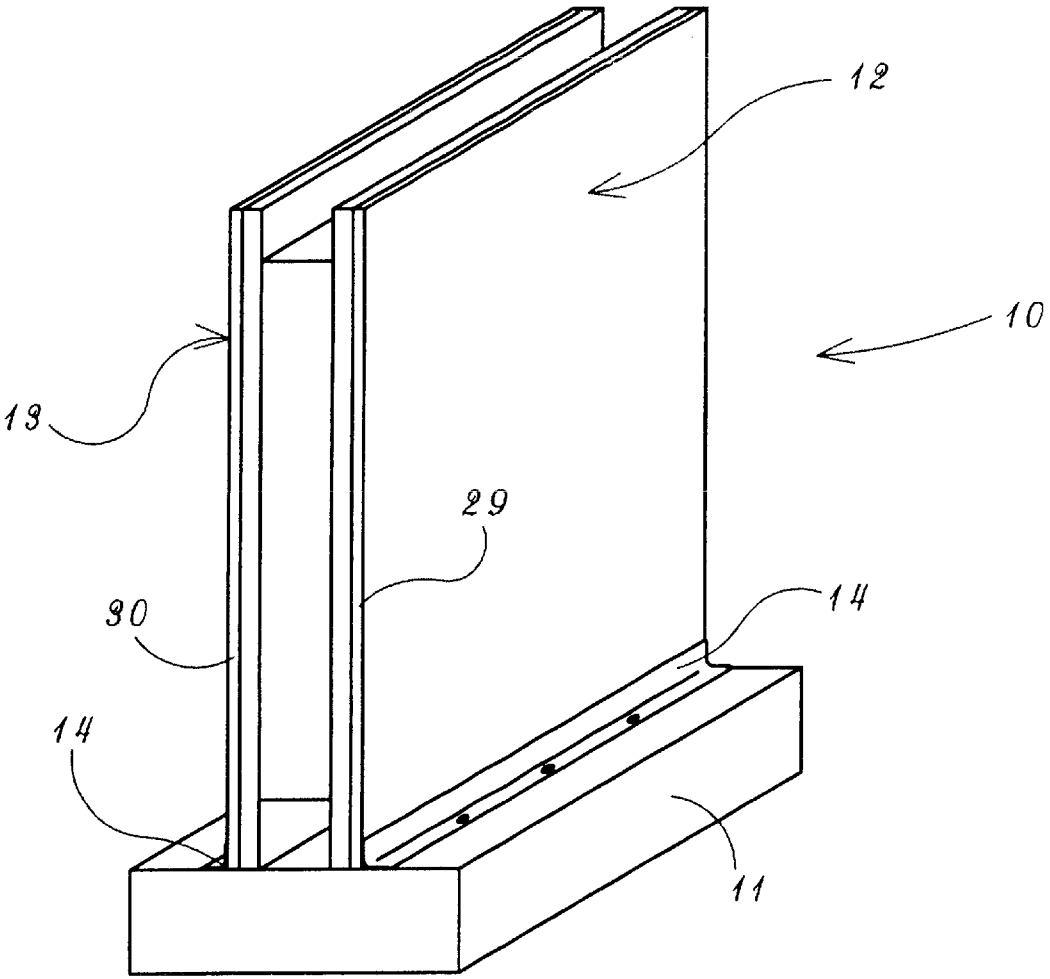
FIG. 1 is a side perspective view of a preferred embodiment of an insulated concrete form building system of the present invention.

Referring now to FIG. 1 a first preferred embodiment of an insulated concrete form wall building system is shown generally at 10. It should be understood by those skilled in the art that the embodiment shown is only one section of an entire system, with each of the sections being identical in construction except for those sections that may have doors or windows. The system 10 is set on top of a standard type foundation footing 11 and includes a pair of elongated expanded polystyrene sidewalls 12 and 13. Spaced apart angle irons 14 are secured to the footing 11 at the base of each of the sidewalls 12 and 13 to hold them in place with respect to the footing 11.

Figure 2:
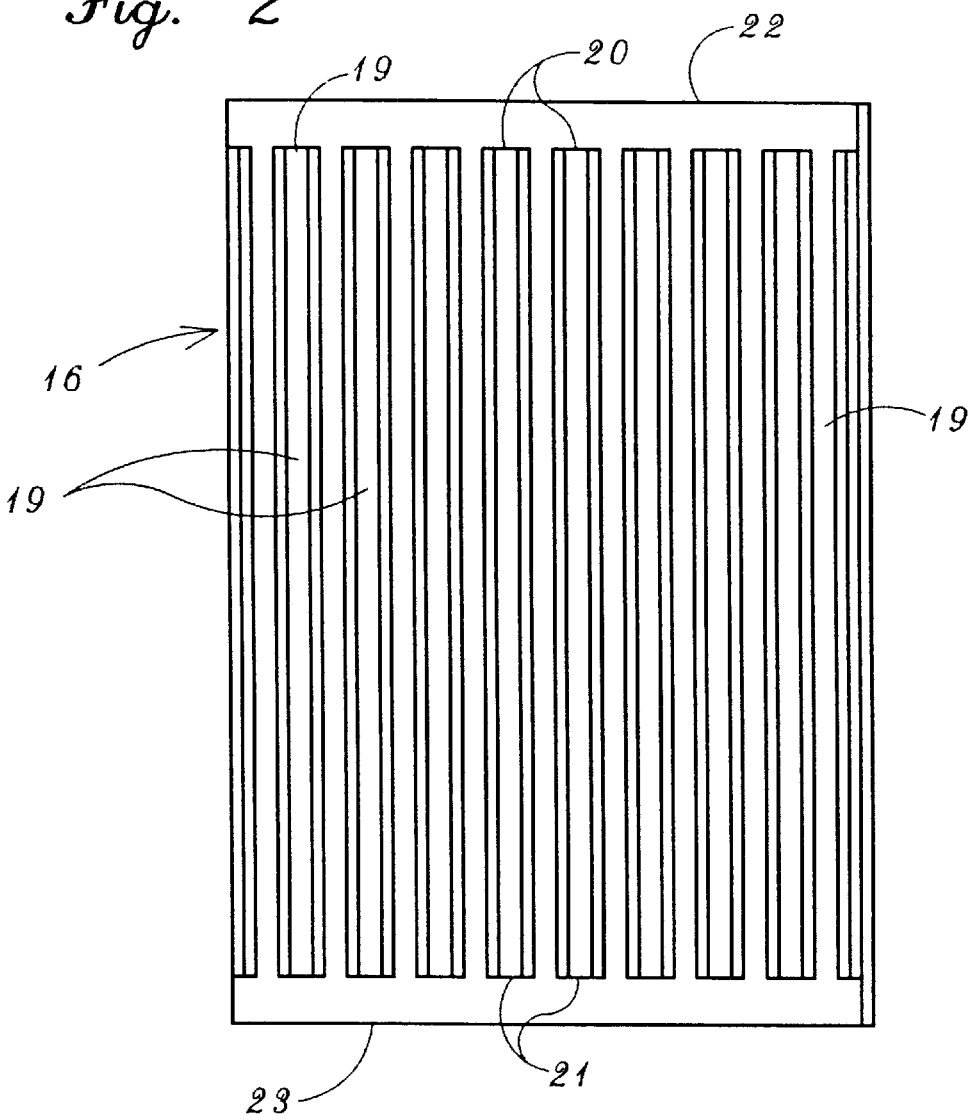
FIG. 2 is a side view in elevation of a sidewall that is used to form a portion of the embodiment of FIG. 1, with the other sidewall of the embodiment being a mirror image of that shown.
Figure 3:
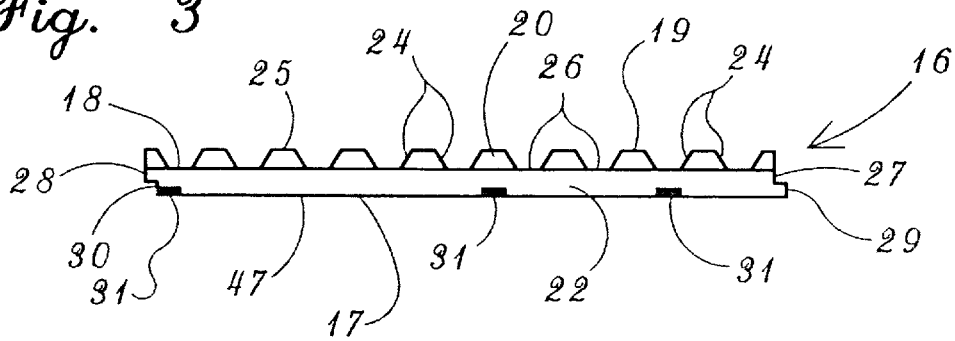
FIG. 3 is a plan view of the sidewall of FIG. 2.

As seen in FIGS. 2 and 3, a sidewall 16 that may serve as either of the sidewalls 13 or 14 is shown. The sidewall 16 has an outer surface 17 (indicated only in FIG. 3) and an inner surface 18 provided with longitudinally spaced apart vertically oriented ribs 19 that project outwardly from the inner surface 18. As seen in FIG. 2, the ribs 19 have top and bottom ends 20 and 21 respectively that are spaced from top and bottom edges 22 and 23 respectively of the sidewall 16. As best shown by FIG. 3, each of the ribs 19 is formed with two inclined side portions 24 that terminate in an outer flat surface 25 to provide channels 26 between the ribs 19 that are in a shape that is a mirror image to that of the ribs 19 so that two sidewalls 16 can be cut from a single sheet of expanded polystyrene by a hot wire. Preferably, side edges 27 and 28 of the sidewall 16 are formed to intermate with an adjacent sidewall 16. The side edge 27 includes a narrow ledge portion 29 and the side edge 28 includes a recessed portion 30 of generally equal size to the ledge portion 29. It is also preferable that the sidewall outer surface 17 includes a plurality of vertically aligned spaced apart recessed furring strips 31 that may be used for attaching finishing materials to the sidewall 16 once an insulated concrete wall structure is completed.

Referring now to FIG. 4, the sidewalls 12 and 13 are positioned with respect to one another so that the flat surfaces 25 of their ribs 19 abut against one another. In such position, the channels 26 between the ribs 19 form an enclosure for receiving concrete that is in a hexagonal shape. Additionally, as shown only in FIG. 5, due to the rib tops 20 and bottoms 21 being spaced apart from the top and bottom sidewall edges 22 and 23 respectively, upper and lower concrete receiving areas 32 and 33 respectively are provided and are in communication with the channels 26 between the ribs 19.

Figure 8:
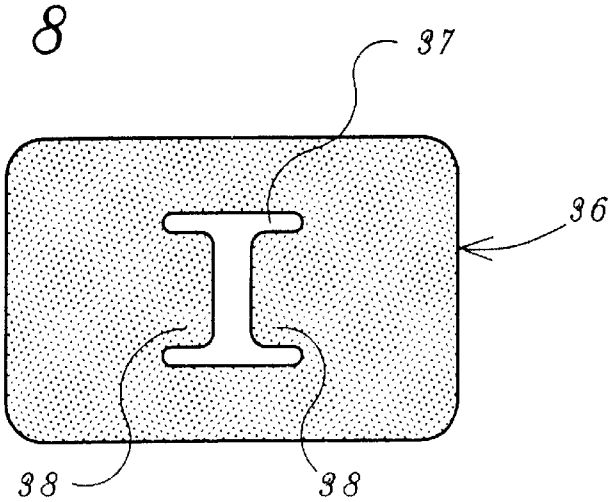
FIG. 8 is a side view in elevation of a rebar clip employed in the embodiment of FIG. 1.
Figure 9:
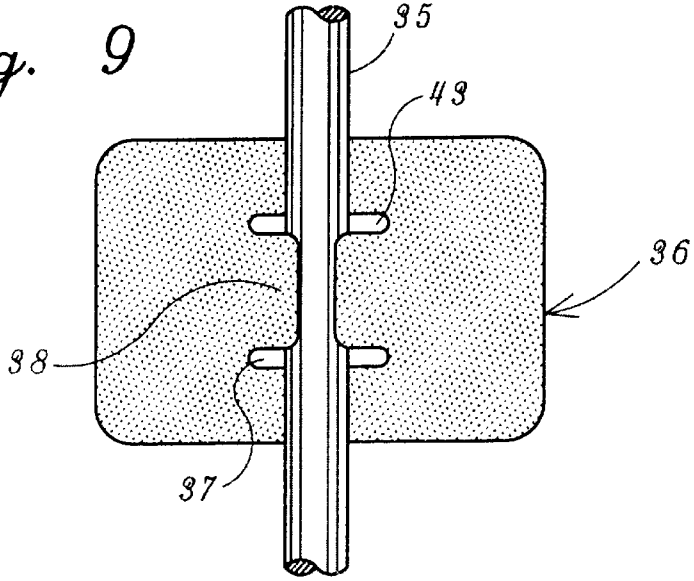
FIG. 9 is a side view in elevation of the rebar clip of FIG. 8 together with a segment of a rebar.
Figure 10:
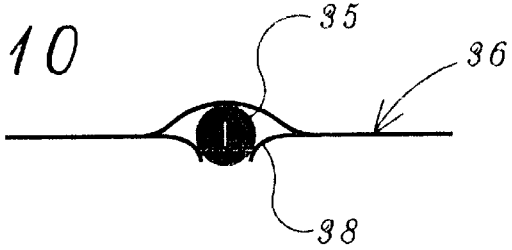
FIG. 10 is a plan view of the rebar clip and rebar of FIG. 9.

To strengthen the wall structure provided by the form system 10, rods of rebar 35 are positioned within the channels 26 (FIGS. 4, 6 and 7) by means of snap-on rebar centering clips 36, shown best in FIGS. 8, 9 and 10. The clips 36 are relatively thin and are formed in a rectangular shape with a center cutout portion 37 that provides two tabs 38 for fastening about the rebar 35 as shown in FIG. 9. Preferably, the clips 36 are formed of a semi-rigid plastic that is bendable for placement of the rebar 35 therein, but sufficiently strong to maintain the rebar in a proper position centered within the channels 26. By use of the clips 36, the rebar can be properly positioned within the channels 26 in a quick and efficient manner.

Figure 12:
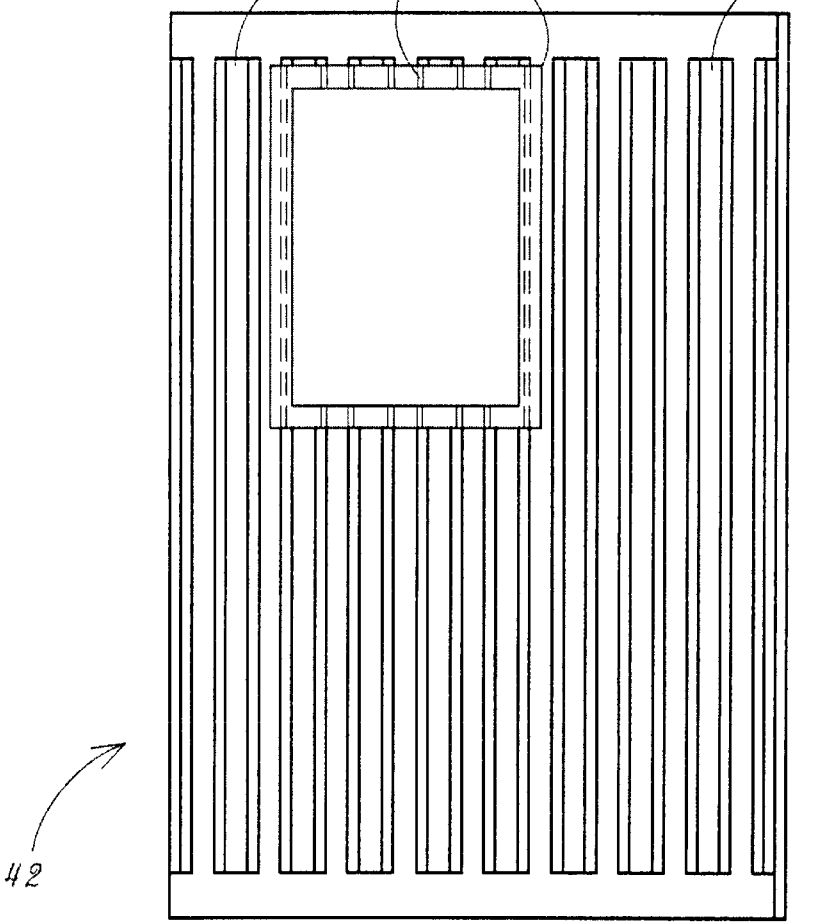
FIG. 12 is a side view in elevation of the sidewall of FIG. 10.
Figure 11:
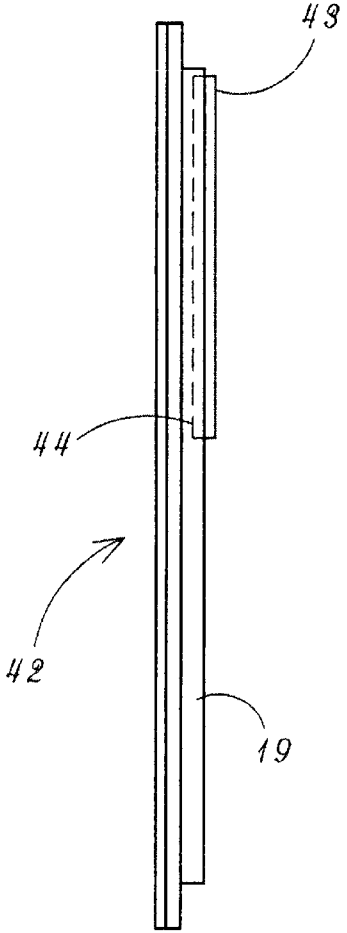
FIG. 11 is an end view in elevation of one of the sidewalls of the embodiment of FIG. 1, together with a window spacer that is attached thereto.

The use of the sidewalls 12 and 13 provides a strong and durable insulated wall structure that is formed without windows or doors. To provide windows or doors in structures produced by the form system 10, a sidewall 42, as shown in FIGS. 11 and 12, is utilized together with a spacer 43. The sidewall 42 differs from the sidewalls 12 and 13 by the fact that portions of the ribs 19 of the sidewall 42 are removed to provide a rectangularly shaped seat 44 corresponding to the shape of a window opening to be formed by the use of the sidewall 42. As an example, the sidewall 42 is designed to provide for a wall structure with a window. Once the portions of the ribs 19 have been removed to form the seat 44, the spacer 43 is installed in the sidewall 42 to prevent the flow of concrete within the removed portions of the ribs 19 and the channels 26 therebetween. When the wall structure is formed and cured, the opening formed by the spacer 43, which is preferably formed of polystyrene, may be cut out.

Thus, it can be seen that the form system 10 of the present invention can be advantageously used to quickly and efficiently form insulated walls. Preferably, a majority of the labor involved in forming the form system 10 can be completed off site. For example, the sidewalls 12 and 13 can readily be provided by the use of cutting a single sheet of polystyrene with the use of a hot wire in the particular configuration desired to include windows or doors as appropriate. The two sidewalls formed by such cutting are then glued together along with any window or door spacers as needed, and the location of the doors and windows are marked on the sidewalls. The fully assembled forms are then delivered to the job site for use.

The system 10 can be made moisture, rodent, and insect resistant by laminating a plastic sheet to the outside surface of a sidewall which will be on the outside of the building. Preferably, this laminated sheet is made of ABS plastic and has a thickness of about 1/16". This can also be assembled with the system off-site.

Figure 13:
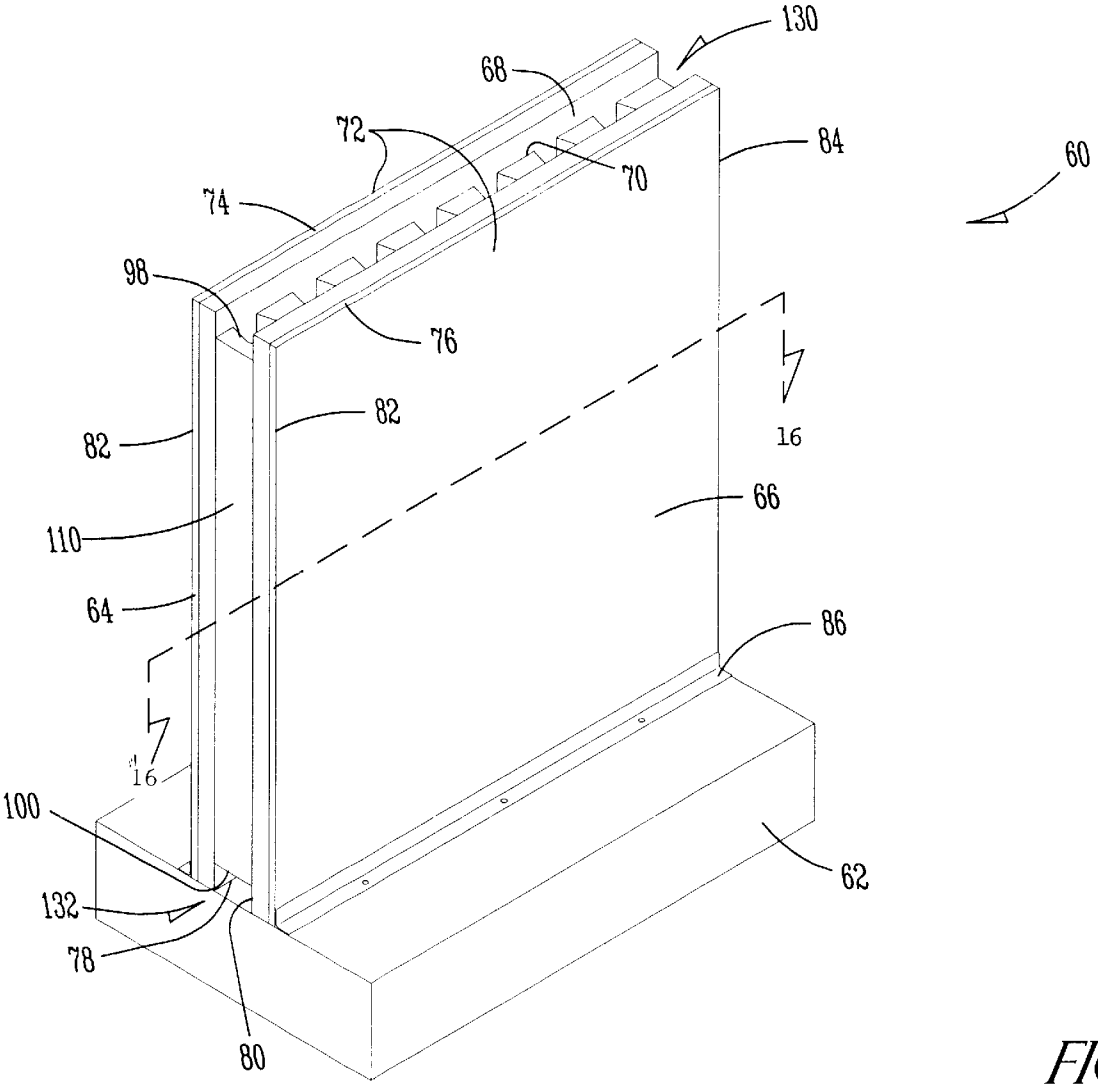
FIG. 13 is aside perspective view of a second preferred embodiment of an insulated concrete form wall building unit of the present invention.

Referring now to FIG. 13 a second preferred embodiment of an insulated concrete form wall building system is shown generally at 60. It should be understood by those skilled in the art that the embodiment shown is only one section of an entire system, with each of the sections being identical in construction except for those sections that may have doors or window. The system 60 is set on top of a standard type foundation footing 62 and includes a pair of elongated expanded polystyrene sidewalls 64 and 66 each having an inner surface 68, 70, an outer surface 72, a top edge 74, 76 and a bottom edge 78, 80 and side edges 82, 84. Spaced apart angle irons 86 are secured to the footing 62 at the bottom edges 78, 80 of the sidewalls 64 and 66 to hold them in place with respect to the footing 62.

Figure 14:
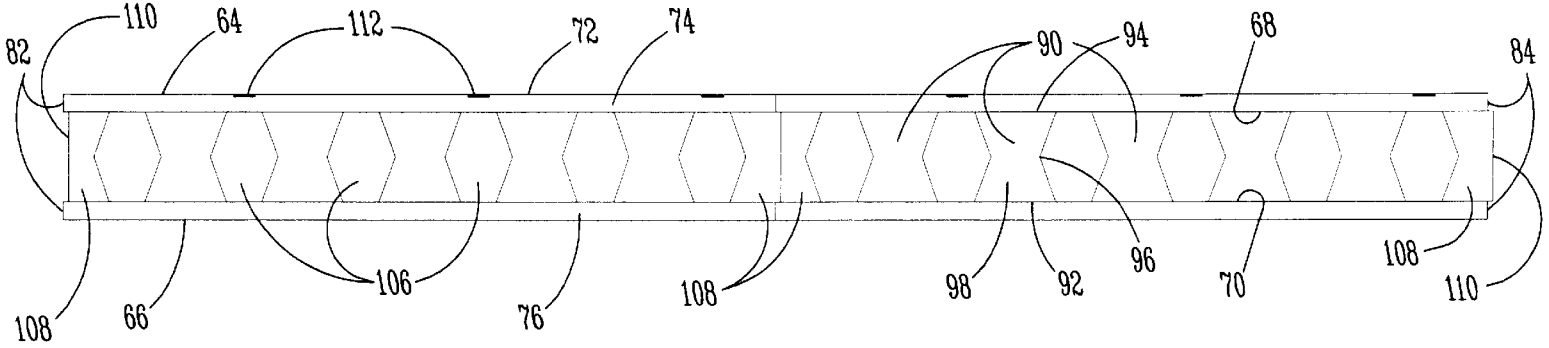
FIG. 14 is a plan view of two units of the concrete form wall building unit of FIG. 13.
Figure 15:
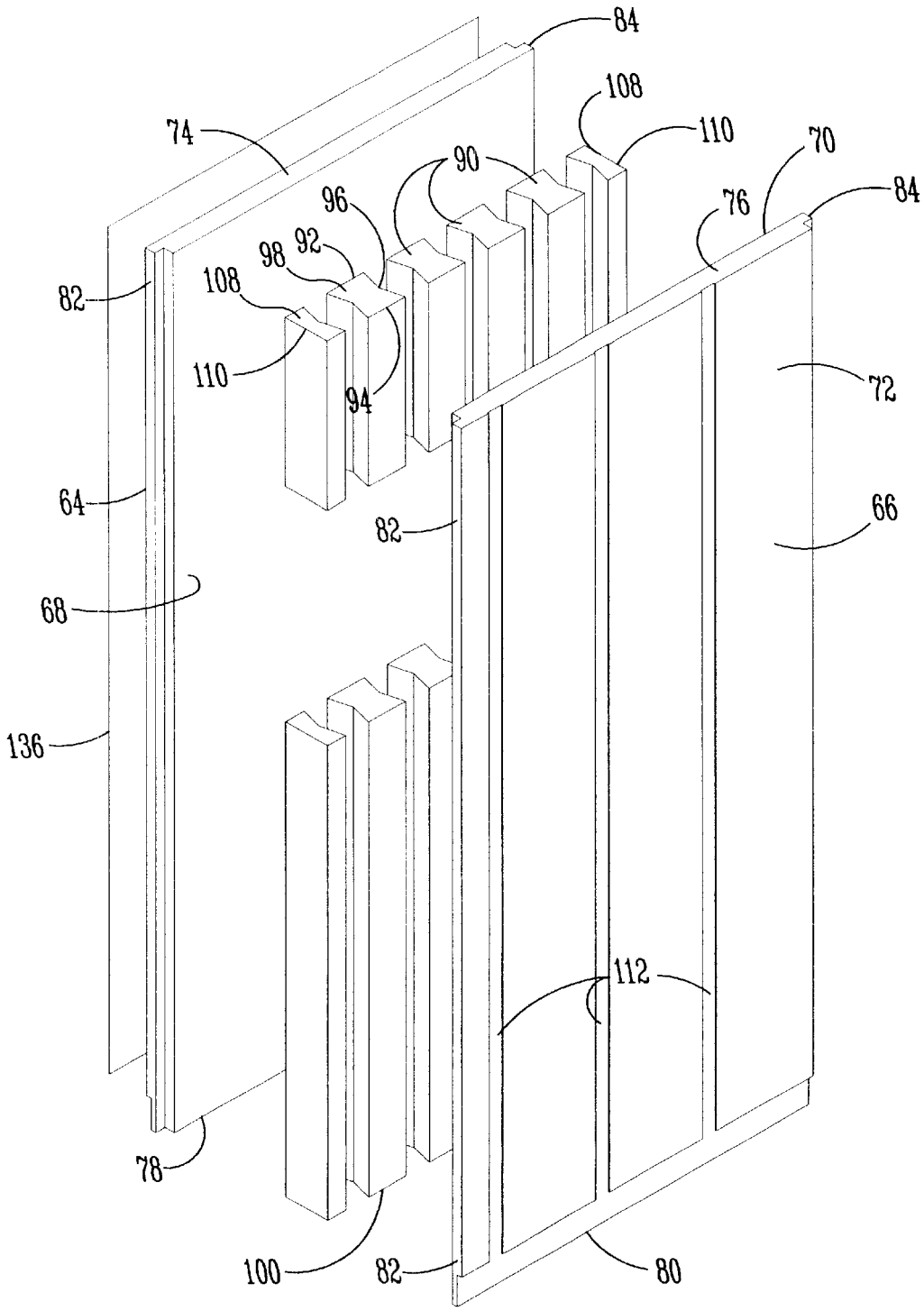
FIG. 15 is an expanded perspective view of FIG. 14.

As seen in FIG. 14 and 15 the two sidewalls 64 and 66 are separated by vertically oriented divisional members 90 that have two flat sides 92 and 94 , a transverse cross section having a mid-point 96, and top and bottom ends 98 and 100 respectively that are spaced from top edges 74 and 76 and bottom edges 78 and 80 of the sidewalls 64 and 66. Each of the divisional members 90 is formed such that the flat sides 92 and 94 are wider than the mid-point 96. When the longitudinally spaced apart divisional members 90 are attached to the inner surfaces 68 and 70 of the sidewalls 64 and 66, channels 106 between the divisional members 90 are formed. These channels 106 are preferably hexagonally shaped. The divisional members 90 placed along the sidewalls 64 and 66 and closest to either side edge 82 or 84 of the sidewalls64 or 66 are a symmetrical half of the divisional member as divided along the vertical axis transverse to the planes of the sidewalls leaving a third flat side 110. One of the half divisional members 108 is positioned such that its third flat side 110 overlaps one of the side edges 82 of the sidewalls 64 and 66, respectively and the other is placed just inside the side edge 84 of the sidewalls 64 and 66 of the system 60. As best shown in FIG. 14, this arrangement provides a formation by which sidewalls 64 and 66 of adjacent systems 60 can be intermated. It is also preferable that the sidewall outer surface 72 includes a plurality of vertically aligned spaced apart recessed furring strips 112 that may be used for attaching finishing materials to the sidewalls 64 and 66 once an insulated concrete wall structure is completed.

Figure 16:
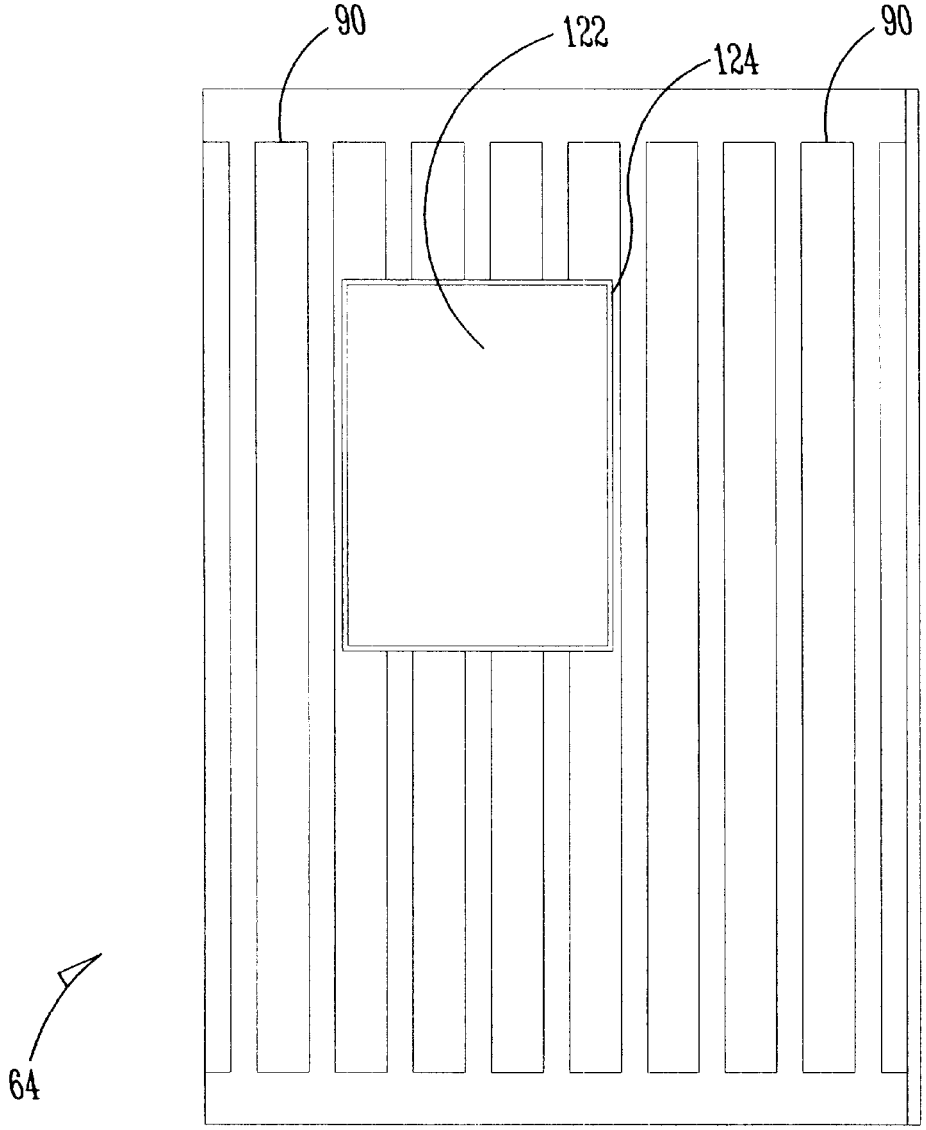
FIG. 16 is a cross section of FIG. 13 along the line 16—16 wherein a seat and spacer are shown assembled.
Figure 17:
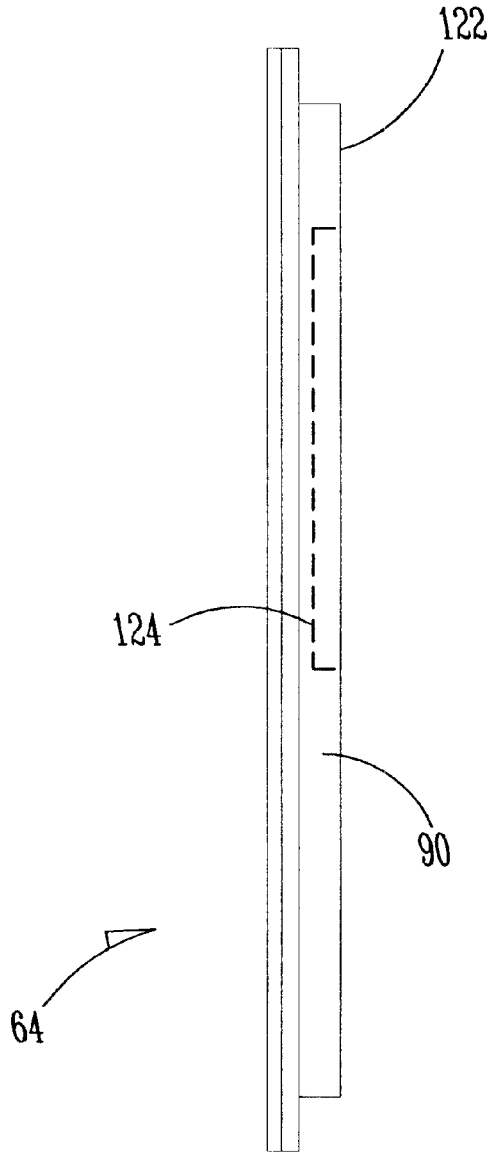
FIG. 17 is an end view of FIG. 16

As shown in FIGS. 15, 16 and 17 to provide windows or doors in structures produced by the form system 60, the divisional members 90 are cut and the remainders used together with a spacer 122. The remaining divisional members 90 are attached to the first of said sidewalls 64 such that a rectangularly shaped seat 124 corresponding to the shape of the window opening is formed. Then, the spacer 122 is installed in the seat 124 and the remaining sidewall 66 is attached to the divisional members 90. When the wall structure is formed and cured, the opening formed by the spacer 122, which is preferably formed of polystyrene, may be cut out.

Preferably, most of the labor involved in forming the form system 60 can be completed off site. For example, the divisional members 90 can be cut to allow for doors or windows, then the divisional members 90 can be positioned and glued to the first sidewall 64, the spacer 122 placed accordingly, and then the divisional members 90 can be glued to the second sidewall 66. The location of the doors and windows are marked on the outside of the sidewalls and the fully assembled forms are delivered to the job site for use.

When concrete is poured into the form 60, it will fill the channels 106. Due to the divisional members' 90 top ends 98 and bottom ends 100 being spaced apart from the top edges 74, 76 and bottom edges 78, 80 of the sidewalls 64 and 66, upper and lower concrete receiving areas 130 and 132 respectively are provided and are in communication with the channels 106.

To strengthen the wall structure provided by the form system 60, rods of rebar are positioned within the channels 106 by means previously described and shown in FIGS. 9 and 10.

The form system 60 can be made water, rodent, and insect resistant by laminating a plastic sheet 136 to the outside surface 72 of the sidewall 64 which will be on the outside of the building. Preferably, this laminated sheet is made of ABS plastic and has a thickness of about 1/16". This can also be assembled with the system off-site.

Although the invention has been described with respect to two preferred embodiments thereof, it is to be understood that it is not to be so limited, since changes and modifications can be made therein, which are within the full intended scope of the invention as defined by the appended claims.

What is claimed is:

1. A concrete form building system comprising:

(a) a first elongated expanded polystyrene sidewall;

(b) a second elongated expanded polystyrene sidewall;

(c) said sidewalls each having opposed inner surfaces;

(d) a plurality of separate divisional members each comprising top and bottom ends, a first and a second flat side and a cross section that is narrower than the width of said flat sides; and (e) means for attaching said first flat side of each of said plurality of divisional members to one of the opposed inner surfaces of said sidewalls and said second flat side to the other of said opposed inner surfaces to provide a concrete wall form with a series of spaced apart hexagonally shaped channels between each of said plurality of divisional members for receiving concrete poured therein.

2. A concrete form building system as recited in claim 1, wherein said first and second sidewalls have top and bottom edges and said top ends of each of said plurality of divisional members are spaced apart from said top edges of said sidewalls and said bottom ends of each of said plurality of divisional members are spaced apart from said bottom edges of said sidewalls to provide upper and lower concrete receiving areas that are in communication with the channels between each of said plurality of divisional members.

3. A concrete form building system as recited in claim 1, wherein divisional members are cut such that an interruption of divisional members results and a solid spacer member is placed within said interruption of the divisional members and said solid spacer member is abutted against and adjacent to said inner surfaces of said sidewalls, to provide preformed places for windows or doors in said sidewalls prior to pouring concrete.

4. A concrete form building system as recited in claim 3, wherein said system further comprises elongated rebar positioned within said spaced apart channels.

5. A concrete form building system as recited in claim 3, wherein said system further includes a rebar clip attached to each of said rebar, said clip having a winged configuration for properly positioning said rebar within said channels.

6. A concrete form building system as recited in claims 4, wherein said first and second sidewalls each have an outer surface and said outer surface of at least one of said first and second sidewalls has spaced apart vertically oriented recesses and furring strips are positioned in said recesses.

7. A concrete form building system as recited in claim 5, wherein said outer surface of at least one of said sidewalls is laminated to a plastic sheet off-site.

8. A concrete form building system comprising:

a) a first elongated expanded polystyrene sidewall;

b) a second elongated expanded polystyrene sidewall;

c) said sidewalls each having opposed inner surfaces and generally planar outer surfaces;

d) divisional members comprising top and bottom ends and four side surfaces wherein two of the side surfaces are generally planar and oriented opposite one another and the third and fourth side surfaces are each of two planar segments positioned at an angle respective to each other such that a cross section of each divisional member has a mid point narrower than the length of its two generally planar sides;

e) means for attaching one of said generally planar side surfaces of each of said divisional members to one of the opposed inner surfaces of said sidewalls and the other of said generally planar side surfaces to the other of said opposed inner surfaces to provide a concrete wall form with a series of spaced apart channels between said divisional members for receiving concrete poured therein.

9. A concrete form building system comprising:

a) a first elongated expanded polystyrene sidewall;

b) a second elongated expanded polystyrene sidewall;

c) said sidewalls each having opposed inner surfaces, a top edge, a bottom edge, and generally planar outer surfaces;

d) a plurality of separate divisional members each comprising top and bottom ends, first and second flat sides and a cross section that is narrower than the width of said flat sides;

e) said plurality of separate divisional members are shorter in length than the heights of said first and second sidewalls;

f) means for attaching said first flat side of each of said plurality of separate divisional members to one of the opposed inner surfaces of said sidewalls and said second flat side to the other of said opposed inner surfaces such that hexagonally shaped channels are formed between said divisional members; and g) said plurality of separate divisional members are positioned such that the top end of each said divisional member is spaced apart from said top edges of said sidewalls and each said bottom end of each said divisional member is spaced apart from said bottom edges of said sidewalls to provide upper and lower concrete receiving areas that are in communication with said channels between said divisional members.

10. A concrete form building system as recited in claim 9 wherein said means for attaching said first and second flat sides of each divisional member to opposed inner surfaces of said sidewalls comprises adhesive.

11. A concrete form building system comprising:

(a) a first elongated expanded polystyrene sidewall;

(b) a second elongated expanded polystyrene sidewall;

(c) said sidewalls each having opposed inner surfaces;

(d) a plurality of separate divisional members each comprising top and bottom ends, a first and a second flat side wherein each of said plurality of separate divisional members further comprises a transverse cross section with a midpoint and said first and second flat sides are wider than said midpoint and the channels formed between said divisional members are substantially hexagonally shaped;

(e) means for attaching said first flat side of each of said plurality of divisional members to one of the opposed inner surfaces of said sidewalls and said second flat side to the other of said opposed inner surfaces to provide a concrete wall form with a series of spaced apart channels between each of said plurality of divisional members for receiving concrete poured therein.

* * * * *